US010077889B1

(12) United States Patent
Qin

(10) Patent No.: US 10,077,889 B1
(45) Date of Patent: Sep. 18, 2018

(54) PROJECTION LAMP WITH ROLLING LAMP EFFECT

(71) Applicant: ACE LIGHT & ELECTRONIC TECH (NINGBO) CO., LTD., Ningbo, Zhejiang Province (CN)

(72) Inventor: Yanbei Qin, Ningbo (CN)

(73) Assignee: ACE LIGHT & ELECTRONIC TECH (NINGBO) CO. LTD. (CN)

( * ) Notice: Subject to any disclaimer, the term of this patent is extended or adjusted under 35 U.S.C. 154(b) by 0 days.

(21) Appl. No.: 15/822,187

(22) Filed: Nov. 26, 2017

(30) Foreign Application Priority Data

Jul. 17, 2017 (CN) ..... 2017 1 0579868

(51) Int. Cl.

| | |
|---|---|
| ***F21S 8/00*** | (2006.01) |
| ***F21V 14/06*** | (2006.01) |
| ***F21V 3/02*** | (2006.01) |
| ***F21V 23/04*** | (2006.01) |
| ***F21S 10/00*** | (2006.01) |
| ***F21V 5/04*** | (2006.01) |
| *F21Y 115/10* | (2016.01) |

(52) U.S. Cl.
CPC ..... *F21V 14/06* (2013.01); *F21S 10/00* (2013.01); *F21V 3/02* (2013.01); *F21V 5/041* (2013.01); *F21V 23/04* (2013.01); *F21Y 2115/10* (2016.08)

(58) Field of Classification Search
USPC ..... 362/284
See application file for complete search history.

(56) References Cited

U.S. PATENT DOCUMENTS 4,998,184 A * 3/1991 Honig ..... B60Q 1/0683 362/284
5,041,948 A * 8/1991 Krieg ..... B60Q 1/0683 362/284

FOREIGN PATENT DOCUMENTS

CN 106322292 A 1/2017

* cited by examiner

*Primary Examiner* — Jamara Franklin
(74) *Attorney, Agent, or Firm* — Adenike Adebiyi

(57) ABSTRACT

A projection lamp with a rolling lamp effect includes an outer housing, which is an inner hollow structure with an opening; a lampshade, which is a light transmitting structure, covering the opening of the outer housing and fixedly connected to the outer housing; a light emitting module, which is fixed in the outer housing through a fixed shaft; and a light condensing ball lens, disposed in the outer housing. A shaft sleeve is disposed on the outer surface of the light condensing ball lens in a protruding way; the light emitting module is positioned in the light condensing ball lens and is fixed in the shaft sleeve; the motor, which is fixedly disposed in the outer housing, is in a transmission connection with the shaft sleeve, and the motor can drive the light condensing ball lens to rotate around the axis of the fixed shaft in the outer housing.

17 Claims, 6 Drawing Sheets

PROJECTION LAMP WITH ROLLING LAMP EFFECT

CROSS-REFERENCE TO RELATED APPLICATIONS

This application claims priority under 35 USC § 119 to Chinese Patent Application No. 201710579868.5, filed 17 Jul. 2017, the disclosure of which is incorporated herein by reference.

TECHNICAL FIELD

The present disclosure belongs to the technical field of projection lamps and relates to a projection lamp with a rolling lamp effect.

BACKGROUND

LED projection lamps are mainly used as decorative lighting and also used for profiling large-sized buildings. The technical parameters thereof are basically similar to those of projection lamps. Relative to the round structure of LED projection lamps, it seems that the heat dissipation device of the strip-like structure of the LED lamp is more easily handled.

So far, projection lamps with a rolling structure have been seen in the projection lamp field. For example, the Chinese Patent Application No. 201510332599.3 (Chinese Patent Publication No. 106322292 A) discloses a projection lamp with a rolling snowflake effect, which comprises a projection device and a bracket disposed at the bottom of the projection device. In this structure, a motor is fixed in a housing; a rotating shaft of the motor is connected to a light condensing ball lens; the rotating shaft is radially opposite to a connecting rod portion, which is connected to a fixed part, relative to the center of the light condensing ball lens, which means that the rotating shaft is coaxial with the connecting rod portion. In this way, the projection lamp can project movable light, and the light effect is more gorgeous and can create different atmospheres. However, the following technical problems exist. In this projection lamp, the rotating shaft and the connecting rod portion are installed at the housing at the same time, which means that two symmetric ends are both connected to the housing. The rotating shaft and the connecting rod portion are coaxially arranged, so the light condensing ball lens has two points connected to the housing. If the light condensing ball lens rotates normally and smoothly, high requirements are imposed on the processing accuracy and installation accuracy of all the parts, resulting in difficulties in the processing and installation of the parts and high inflexibility in use.

SUMMARY

One aspect of the present disclosure is a projection lamp with a rolling lamp effect that has low requirements for its processing accuracy and installation accuracy and is conveniently processed and installed.

In one example embodiment, a projection lamp with a rolling lamp effect includes an outer housing, which is an inner hollow structure with an opening; a lampshade, which is a light transmitting structure, covering the opening of the outer housing and fixedly connected to the outer housing; a light emitting module, fixed in the outer housing through a fixed shaft, wherein the light projecting direction of the light emitting module points at the lampshade; a light condensing ball lens, disposed in the outer housing, wherein a shaft sleeve is disposed at the outer surface of the light condensing ball lens in a protruding way, the light emitting module is positioned in the light condensing ball lens and the fixed shaft is positioned in the shaft sleeve; and a motor which is fixedly disposed in the outer housing and is in a transmission connection with the shaft sleeve, wherein the motor is capable of driving the light condensing ball lens to rotate around the axis of the shaft sleeve in the outer housing.

In one example embodiment, the shaft sleeve is externally sleeved with a transmission sleeve which is in a fixed connection with the shaft sleeve; the transmission sleeve is in a transmission connection with the motor through a gear, and the shaft sleeve is capable of synchronously rotating along with the transmission sleeve.

In one example embodiment, the transmission sleeve has one end which is fixedly connected with a gear ring; the gear ring is internally provided with a positioning bearing; the positioning bearing is pressed against the transmission sleeve and respectively tightly fits with the gear ring and the fixed shaft; an output shaft of the motor is provided with a gear, and the gear is in an engaged connection with the gear ring.

In one example embodiment, the inner diameter of the gear ring is greater than the inner diameter of the transmission sleeve; a platform is formed between the transmission sleeve and the gear ring; and the positioning bearing is pressed against the platform.

In one example embodiment, the transmission sleeve is sleeved with a positioning ring; the positioning ring is positioned between the motor and the lampshade and remains fixed relative to the motor and the lampshade; and the transmission sleeve is capable of rotating in the positioning ring.

In one example embodiment, a support board is disposed between the motor and the positioning ring; the support board has one end pressed against the motor and the other end provided with an arc-shaped groove; and the positioning ring is positioned in the arc-shaped groove and is tightly pressed against the support board.

In one example embodiment, a baffle, which is fixedly connected with the support board and tightly presses the positioning ring against the transmission sleeve, is disposed on one side of the arc-shaped groove.

In one example embodiment, an arc-shaped positioning sleeve is disposed at one end of the support board; the two ends of the arc-shaped positioning sleeve respectively extend out of a mounting portion; a mounting seat is disposed on the inner surface of the outer housing; the motor is disposed in the mounting seat; the motor is positioned in the arc-shaped sleeve, and the mounting portion is fixedly connected with the mounting seat.

In one example embodiment, a main cover plate is fixedly disposed in the outer housing; a limiting seat is fixedly disposed on the inner surface of the main cover plate; the limiting seat is formed with a limiting groove; and the positioning ring is positioned in the limiting groove and pressed against the limiting seat.

In one example embodiment, a stopper is disposed on one side of the limiting seat, and the positioning ring is pressed against the stopper.

In one example embodiment, an auxiliary cover plate is fixedly disposed in the outer housing; a limiting plate is fixedly disposed on the inner surface of the auxiliary cover plate; the limiting plate is formed with a limiting hole; a limiting shaft which is coaxial with the shaft sleeve is disposed on the outer surface of the light condensing ball lens in a protruding way; and the limiting shaft extends into the limiting hole and is spaced from the limiting hole.

In one example embodiment, the outer housing is internally provided with a fixed seat which is in a fixed connection with the outer housing; the fixed seat is provided with a fixed sleeve; and the fixed shaft is fixedly connected with the fixed sleeve in a plugged way.

In one example embodiment, a plug board, which is in a plugged connection with the inner surface of the outer housing, is disposed on the lower surface of the fixed seat in a protruding way.

In one example embodiment, the light emitting module of the projection lamp with a rolling lamp effect includes a lamp base, having two adjacent mounting grooves which are disposed in an inclined way; two lamp panels respectively embedded in two mounting grooves, wherein each one of the lamp panels is provided with a light emitting element; a connecting board, fixedly connected to one side of the lamp base, wherein a connecting sleeve is fixedly disposed on the surface of the connecting board, and the fixed shaft is fixedly connected with the connecting sleeve in a plugged way.

In one example embodiment, the light condensing ball lens is enclosed by two left and right hollow semi-spheres; a plurality of convex lenses which are connected in turn are uniformly disposed on the inner surface of each one of the two left and right semi-spheres; each one of the shaft sleeve and the limiting shaft is enclosed by parts which are respectively positioned on the two left and right semi-spheres; and the light emitting module is positioned in the two semi-spheres.

In one example embodiment, the limiting shaft is sleeved with a shaft cover, and the shaft cover is in a plugged connection with the limiting shaft.

In one example embodiment, the outer housing is internally equipped with a circuit board; the circuit board is electrically connected with the light emitting module and the motor, respectively; and the circuit board is provided with a power switch and a wiring plug that penetrate through the outer housing and are fixedly connected with the outer housing.

The present disclosure may have the following beneficial effects:

In one example embodiment, the light condensing ball lens is connected with the fixed shaft in the outer housing through the shaft sleeve which is disposed on the outer surface thereof, the light condensing ball lens rotates through the transmission connection between the motor and the shaft sleeve such that the shaft sleeve plays a dual role of connecting the light condensing ball lens and driving the light condensing ball lens to rotate, so the whole structure realizes a single-point connection between the light condensing ball lens and the outer housing. The requirements for the processing accuracy and the installation process of all parts are low such that all parts are conveniently processed and installed, so the whole mounting structure is simplified and the use is very flexible.

DETAILED DESCRIPTION

Figure 1:
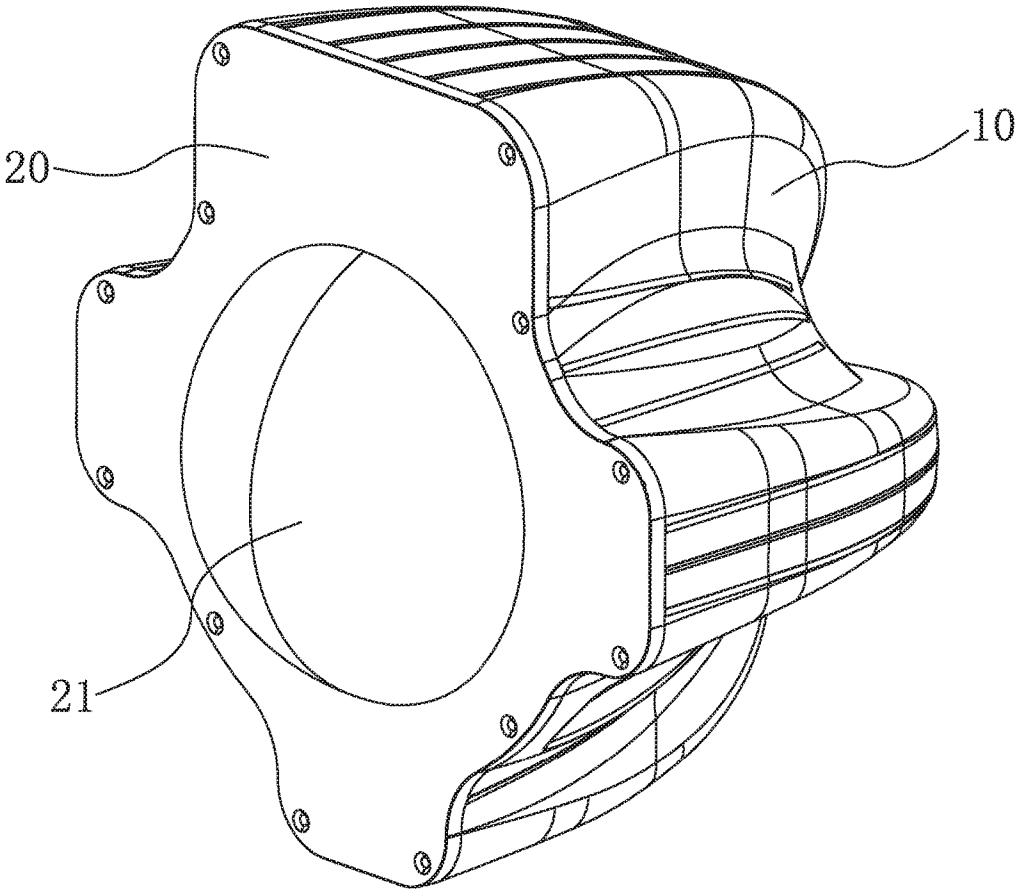
FIG. 1 is a front three-dimensional view of the present disclosure.
Figure 2:
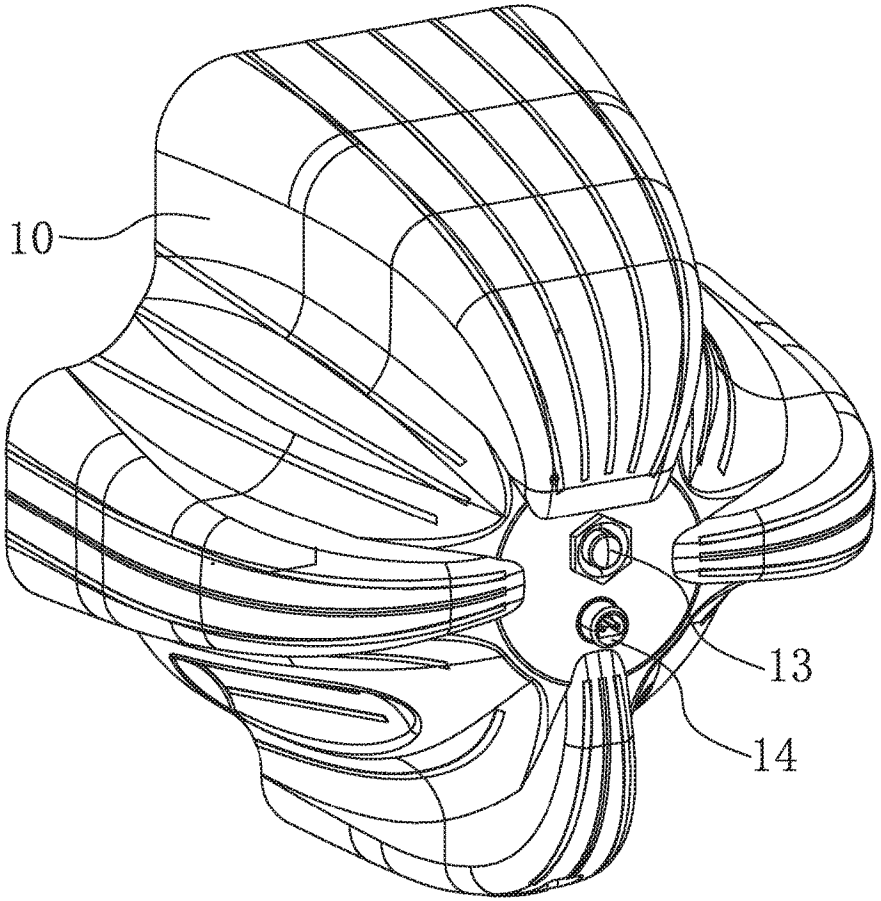
FIG. 2 is a rear three-dimensional view of the present disclosure.

The technical solution of the present disclosure is further described in conjunction with the preferred embodiments and attached drawings of the present disclosure, but the present disclosure is not limited to these embodiments.

The present disclosure makes improvements on existing projection lamps for the purposes of simplifying the mounting structure of the light condensing ball lens and the outer housing, lowering the requirements for the processing accuracy and installation accuracy of all parts, improving the processing and installation efficiency of the parts, and reducing cost.

As shown in FIGS. 1-5, the present disclosure discloses a projection lamp with a rolling lamp effect, including an outer housing 10, a lampshade 20, a light emitting module 30, a light condensing ball lens 40 and a motor 50.

The projection shape of the outer housing 10 is a "+" shape. The outer housing 10 is an inner hollow structure and has a "+"-shaped opening on the front elevation. The lampshade 20 is a light transmitting structure made of light transmitting materials, covering the opening of the outer housing 10 and fixedly connected with the outer housing 10 through connections such as screws. The middle portion of the lampshade 20 protrudes outward from the inside to form a spherical protrusion portion 21. The light emitting module 30 is disposed at the middle in the outer housing 10. A fixed shaft 11 is disposed between the light emitting module 30 and the outer housing 10. The fixed shaft 11 has one end fixedly connected with the light emitting module 30 and has the other end connected with the outer housing 10. The light projection direction of the light emitting module 30 points at the lampshade 20. The light condensing ball lens 40 is an inner hollow spherical structure. To facilitate the installation of the light emitting module 30, the light condensing ball lens 40 is enclosed by two left and right inner hollow semi-spheres. A plurality of round convex lenses 41 which are connected with one another are uniformly distributed on the inner surface of each one of the two left and right semi-spheres. The light condensing ball lens 40 is disposed in the outer housing 10 and extends into the spherical protrusion portion 21. A shaft sleeve 42 is disposed on the outer surface of the light condensing ball lens 40 in a protruding way. The shaft sleeve 42 is enclosed by parts which are respectively positioned on the two left and right semi-spheres. The axis of the shaft sleeve 42 is superimposed with the circle center of the light condensing ball lens 40. The light emitting module 30 is positioned in the light condensing ball lens 40. The fixed shaft 11 is positioned in the shaft sleeve 42 and is fixed relative to the shaft sleeve 42. The motor 50 is fixedly disposed in the outer housing 10 and is in a transmission connection with the shaft sleeve 42. The outer housing 10 is also internally equipped with a circuit board 12. The circuit board 12 is electrically connected with the light emitting module 30 and the motor 50 at the same time. The circuit board 12 is provided with a power switch 13 for controlling the motor 50 and the light emitting module 30. The power switch 13 passes through the outer housing 10 and is fixed with the outer housing 10. A wiring plug 14 which is electrically connected with the circuit board 12 and is connected with the outer housing 10 is also disposed between the circuit board 12. The wiring circuit 14 is electrically connected with an external power supply. The wiring circuit 14 passes through the outer housing 10 and is fixed with the outer housing 10.

During working, the motor 50 drives the light condensing ball lens 40 to rotate around the axis of the shaft sleeve 42 in the outer housing 10. The motionless light emitting module 30 projects light toward the lampshade 20. The light rays are projected to the convex lens portion 41 in the moving light condensing ball lens 40 and form movable light spots with a snowflake shape or other shapes on projected objects outside the light condensing ball lens 40.

In this structure, the light condensing ball lens 40 and the outer housing 10 form a single-point fixed connection through the fixed shaft 11; the shaft sleeve 42 plays a supporting and rotating role. The single-point connection ensures low requirements for processing accuracy and installation accuracy of all parts of the projection lamp, facilitates processing and installation of all products, simplifies structure, and reduces cost to a certain degree.

On the basis of the above structure, the present disclosure makes further improvements and detailing.

Figure 3:
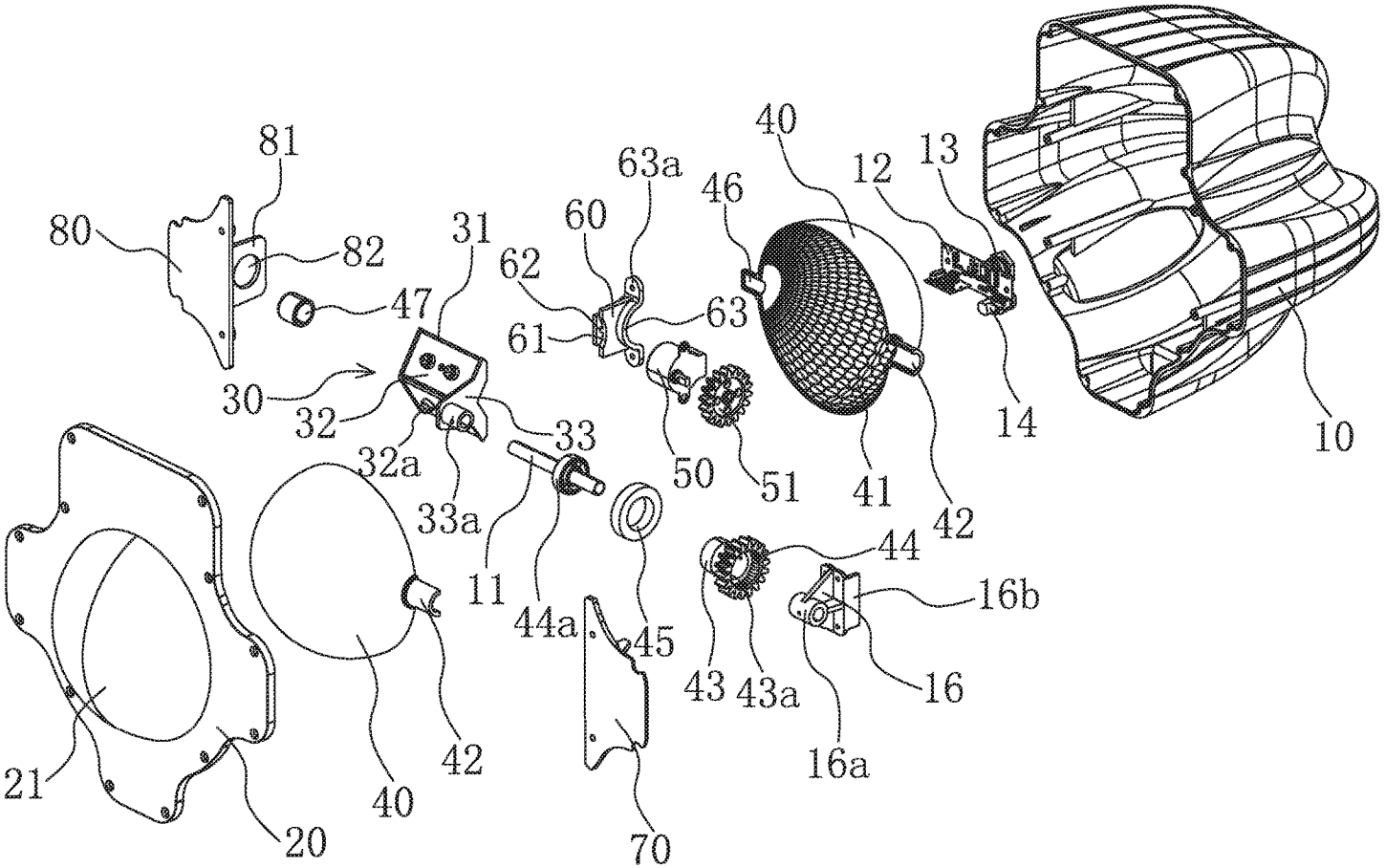
FIG. 3 is an exploded view of the present disclosure.
Figure 4:
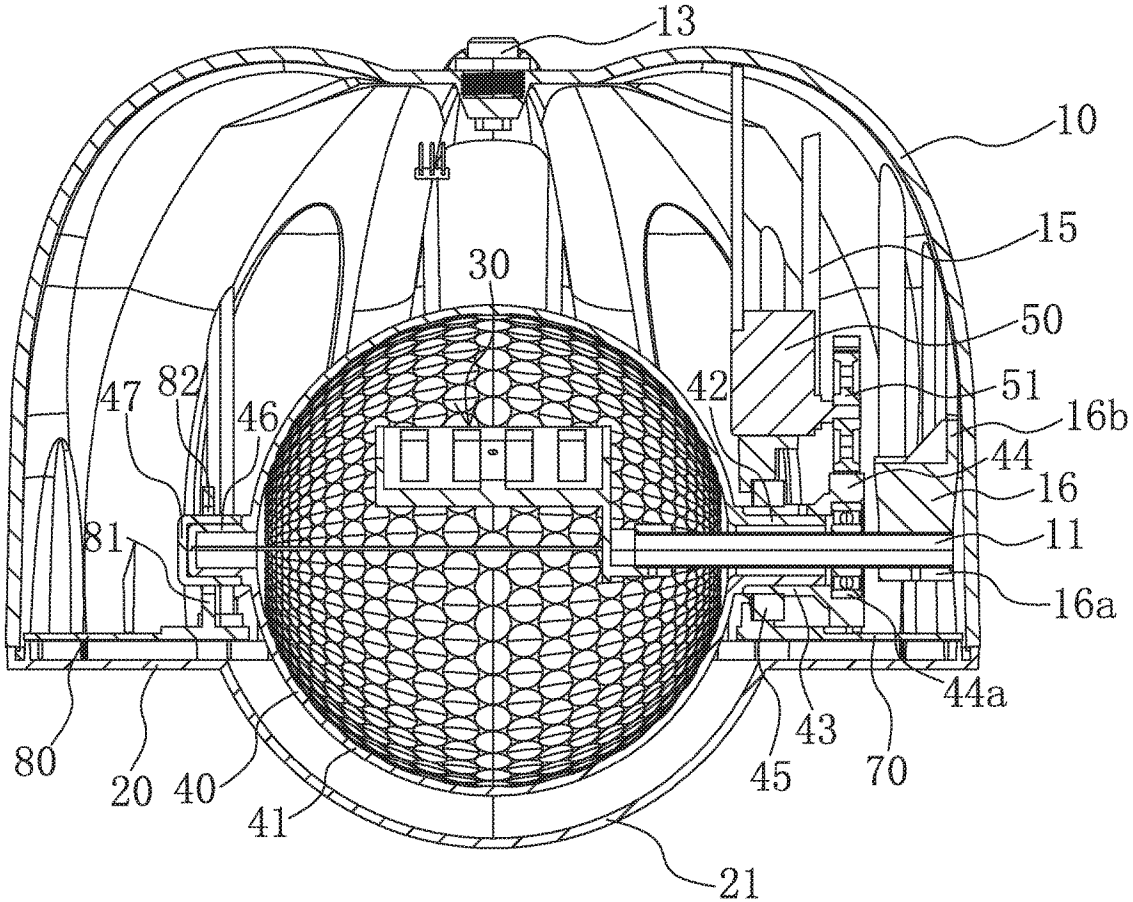
FIG. 4 is a sectional view of an outer housing and the internal structure thereof in the present disclosure.
Figure 5:
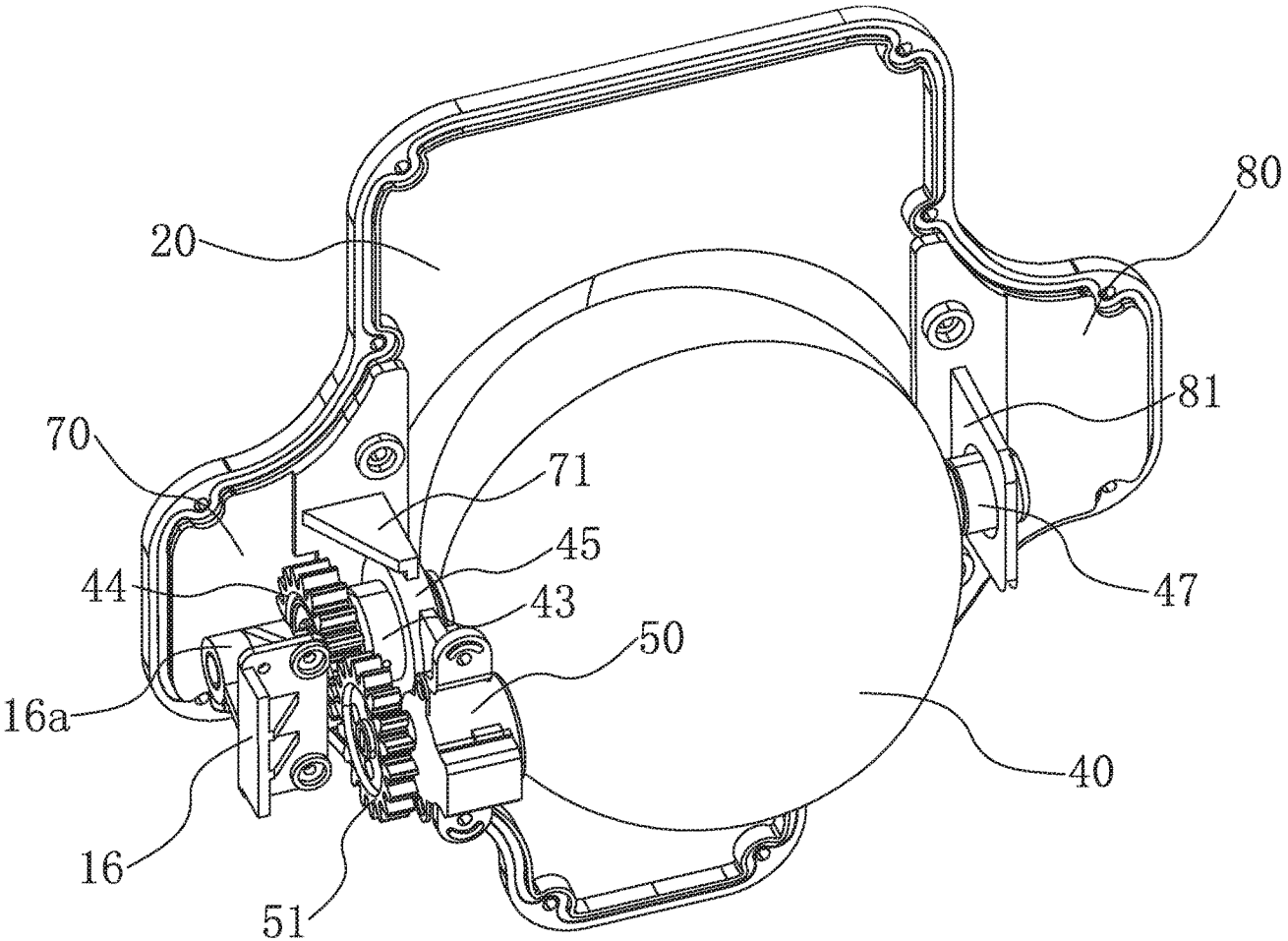
FIG. 5 is a three-dimensional view of some structure in the present disclosure.
Figure 7:
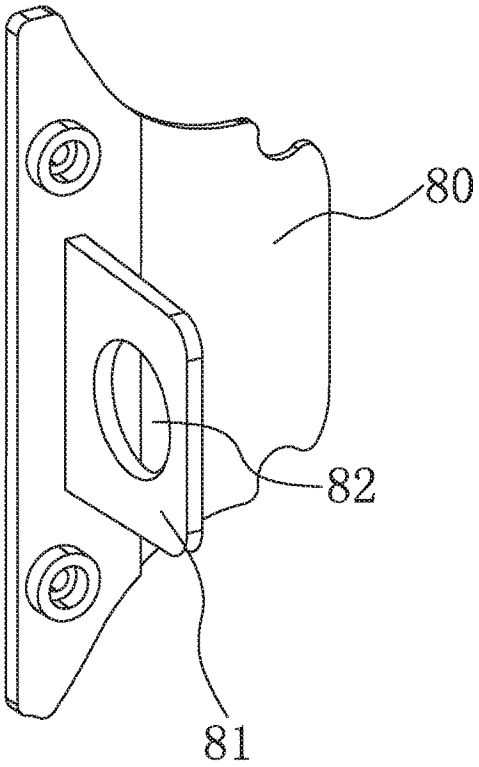
FIG. 7 is a three-dimensional view of a secondary cover plate in the present disclosure.
Figure 6:
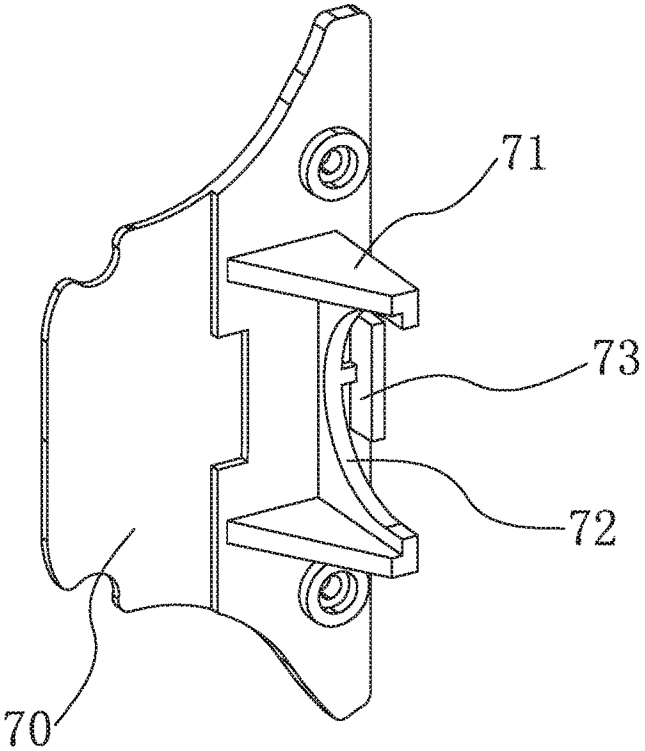
FIG. 6 is a three-dimensional view of a main cover plate in the present disclosure.

As shown in FIGS. 3-5, the shaft sleeve 42 is externally sleeved with a transmission sleeve 43 which is in a fixed connection with the shaft sleeve; the transmission sleeve 43 is fixed with the lampshade 20 relative to the outer housing 10 in the radial direction thereof; the transmission sleeve 43 and the motor 50 are in a transmission connection through a gear 51 and the shaft sleeve 42 can synchronously rotate along with the transmission sleeve 43.

Preferably, the transmission sleeve 43 has one end which is fixedly connected with a gear ring 44; the inner diameter of the gear ring 44 is greater than the inner diameter of the transmission sleeve 43; a platform 43*a* is formed between the transmission sleeve 43 and the gear ring 44; the gear ring 44 is internally provided with a positioning bearing 44*a*; the positioning bearing 44*a* is pressed against the platform and respectively fits tightly with the gear ring 44 and the fixed shaft 11; and an output shaft of the motor 50 is provided with the gear 51. Here, the output shaft of the motor 50 and the fixed shaft 11 are disposed in parallel, and the gear 51 is in an engaged connection with the gear ring 44.

The whole shaft sleeve 42 is enclosed by parts which are respectively positioned on the two semi-spheres; the transmission sleeve 43 fixes the two convex sleeves to form the shaft sleeve 42 and also plays the role of fixing the two semi-spheres, thus improving the integrity of the light condensing ball lens 40; the configuration of the positioning bearing 44*a* enhances the stability of the gear ring 44 and the transmission sleeve 43 in the radial direction such that the gear ring 44 and the transmission sleeve 43 rotate more stably and flexibly; besides, the positioning bearing 44*a* is pressed against the platform 43*a* to prevent the positioning bearing from moving axially; the transmission sleeve 43 and the motor 50 are in a transmission connection through the gear 51 and the gear ring 44 such that the light condensing ball lens 40 rotates stably; moreover, the gear 51 also plays the role of supporting the gear ring 44, improving the stability of the light condensing ball lens 40.

Of course, the transmission between the transmission sleeve 43 and the motor 50 can also be implemented by other means, for example a worm and gear transmission.

As shown in FIGS. 3-5, the transmission sleeve 43 is sleeved with a positioning ring 45; the positioning ring 45 is positioned between the motor 50 and the lampshade 20 and remains fixed relative to the motor and the lampshade. The transmission sleeve 43 can rotate in the positioning ring 45, which means that the positioning ring 45 is pressed against the motor 50 and the lampshade 20 directly or indirectly such that the positioning ring 45 remains fixed.

In this structure, the fixed shaft 11 is motionless, and the shaft sleeve 42 and the fixed shaft 11 are supported only by one support point, namely the positioning bearing 44*a* between the transmission sleeve 43 and the fixed shaft 11, resulting in that the light condensing ball lens 40 is unstable and tends to shake in the outer housing 10. By configuring the positioning ring 45, a support point is added onto the transmission sleeve 43 such that the whole transmission sleeve 43 forms a two-point support, thus improving the stability of the light condensing ball lens 40; moreover, the positioning ring 45 entirely encloses the periphery of the transmission sleeve 43, achieving a good effect of positioning the transmission sleeve 43.

Further, a support board 60 is disposed between the motor 50 and the positioning ring 45; the support board 60 has one end pressed against the motor 50 and the other end provided with an arc-shaped groove 61; the positioning ring 45 is positioned in the arc-shaped groove 61 and is tightly pressed against the support board 60; a baffle 62 which is fixedly connected with the support board is disposed on one side of the arc-shaped groove 61; a limiting boss (not shown in the figures) is disposed on the transmission sleeve 43, and the positioning ring 45 is respectively pressed against the baffle 62 and the limiting boss.

As shown in FIGS. 3-6, a main cover board 70 is fixedly disposed at the exit of the outer housing 10; the main cover plate 70 is close to the lampshade 20; a limiting seat 71 is fixedly disposed on the inner surface of the main cover plate 70; the limiting seat 71 is formed with a limiting groove 72; the positioning ring 45 is positioned in the limiting groove 72 and is pressed against the limiting seat 71; a stopper 73 is disposed on one side of the limiting seat 71, and the positioning ring 45 is pressed against the stopper 73.

By configuring the support board 60 and the limiting seat 71, two opposite fixing points are formed on the outer surfaces on two sides of the positioning ring 45, thus playing the role of fixing the positioning ring 45, improving the stability of the positioning ring 45 in the radial direction, and achieving a good effect of fixing the positioning ring 45. The baffle 62, the limiting boss, and the stoppers 73 all play the role of limiting the positioning ring 45 from moving axially, thus ensuring the stability of the positioning ring 45 in the axial direction.

It is worth mentioning that the limiting seat 71 can be directly disposed on the lampshade 20, and when the lampshade 20 is fixedly connected with the outer housing 10, the limiting seat 71 can be directly pressed against the positioning ring 45.

As shown in FIG. 3, an arc-shaped positioning sleeve 63 is disposed at one end of the support board 60; the two ends of the arc-shaped positioning sleeve 63 respectively extend out of the mounting portion 63*a*; a mounting seat 15 is disposed on the inner surface of the outer housing 10; the motor 50 is disposed in the mounting seat 15; the motor 50 is positioned in the arc-shaped positioning sleeve 63 and the mounting portion 63*a* is fixedly connected with the mounting seat 15 through connections such as screws.

Through the arc-shaped positioning sleeve 63, the motor 50 can be directly fixed on the mounting seat 15 without extra fixation between the motor 50 and the mounting seat 15, thus facilitating the installation of the motor 50. At the same time, the support board 60 is fixed with the outer housing 10, also improving the stabilization effect of the support board 60.

As shown in FIGS. 3, 4, 5, and 7, an auxiliary cover plate 80 is fixedly disposed in the outer housing 10; a limiting plate 81 vertical to the auxiliary cover plate 80 is fixedly disposed on the inner surface of the auxiliary cover plate 80; the limiting plate 81 is formed with a limiting hole 82; a limiting shaft 46 which is coaxial with the shaft sleeve 42 is disposed on the outer surface of the light condensing ball lens 40 in a protruding way; the limiting shaft 46 is also enclosed by two parts which are respectively disposed on the two semi-spheres in a protruding way; the limiting shaft 46 is sleeved with a shaft cover 47; the whole limiting shaft 46 is in a plugged connected with the shaft cover 47; the shaft cover 47 and the limiting shaft 46 extend into the liming hole 82 and are spaced from the limiting hole 82, which means that under normal conditions the shaft cover 47 and the limiting plate 81 remain in a non-contact state.

The positioning bearing 44*a* and the positioning ring 45 form two support points of the light condensing ball lens 40, but the two support points are both positioned on the same side of the light condensing ball lens 40. In this circumstance, the light condensing ball lens 40 shakes when the outer housing 10 is moved or impacted, greatly affecting the two support points of the light condensing ball lens 40 and the overall stability of the light condensing ball lens 40.

By combination between the limiting plate 81 and the limiting shaft 46, the limiting plate 81 can stop the limiting shaft 46 when the light condensing ball lens 40 shakes to prevent the light condensing ball lens 40 from shaking vigorously, thus improving the stability of the light condensing ball lens 40 when the outer housing 10 is impacted or moved.

The shaft cover 47 fixes the two parts of the limiting shaft 46, thus playing the role of fixing the light condensing ball lens 40 on the other side of the light condensing ball lens 40.

It is worth mentioning that the limiting shaft 46 does not have a support effect, but only aids in preventing the light condensing ball lens 40 from shaking vigorously.

As shown in FIGS. 3 and 4, the outer housing 10 is internally provided with a fixed seat 16; the fixed seat 16 is fixedly connected with the outer housing 10 through connections such as screws; the fixed seat 16 is provided with a fixed sleeve 16*a*; and one end of the fixed shaft 11 is fixedly connected with the fixed shaft 16*a* in a plugged way.

By using this structure, the fixed shaft 11 and the outer housing 10 are flexibly dismantled and installed, and the plugged connection ensures that the fixing effect of the fixed shaft 11 is relatively good.

Further, a plug board 16*b* is disposed on the lower surface of the fixed seat 16 in a protruding way; the inner surface of the outer housing 10 is formed with a corresponding slot (not shown in the figures); and the plug board 16*b* is connected with the slot in a plugged way.

Through the combination between the plug board 16*b* and the slot, the fixed seat 16 can be fixed on the inner surface of the outer housing 10 in advance, and the positioning is fast and accurate and facilitates the subsequent connection between the fixed seat 16 and the outer housing 10 by using screws.

As shown in FIG. 3, the light emitting module 30 includes a lamp base 31, lamp panels 32 and a connecting plate 33.

The lamp base 31 is integrally "V" shaped, having two adjacent inclined mounting grooves on the outer surface thereof. Two lamp panels 32 are provided; the two lamp panels 32 are respectively embedded in the two mounting grooves and are fixedly connected with the lamp base 31; each one of the lamp panels 32 is provided with a light emitting element 32*a*; and the light emitting elements 32*a* are electrically connected with the circuit board 12. Preferably, the light emitting elements 32*a* are LED lamps. The connecting plate 33 is fixedly connected to one side of the lamp base 31. A connecting sleeve 33*a* is fixedly disposed on the outer surface of the connecting plate 33. The other end of the fixed shaft 11 is fixedly connected with the connecting sleeve 33*a* in a plugged way.

The lamp base 31 is in a plugged connection with the fixed shaft 11 to facilitate the dismantling and installation of the fixed shaft 11 and the lamp base 31, and the structure of the lamp base 31 and the connection structure of the lamp panels 32 and the lamp base 31 can both be other structures and are not limited to the structure as mentioned in this embodiment.

The working principle of the present disclosure is as follows:

In use, the projection lamp is electrically connected to an external power supply through the wring plug 14; then, the power switch 13 is turned on; and the circuit board 12 respectively powers the motor 50 and the light emitting elements 32*a*.

The motor 50 drives the light condensing ball lens 40 to rotate around the axis of the shaft sleeve 42; the light emitting elements 32*a* emit light which is projected to external projected objects through the convex lens portion 41 on the light condensing ball lens 40 and the lampshade 20; and as the light condensing ball lens 40 rotates, the surfaces of the projected objects form moving light spots similar to snowflake.

When the projection lamp is moved or the projection lamp is impacted, the limiting shaft 46 contacts the limiting plate 81 to prevent the light condensing ball lens 40 from shaking vigorously, thus ensuring the stability of the light condensing ball lens 40.

The specific embodiments described in the text are used for illustrating the principle of the present disclosure only. Those skilled in the art can make various amendments or supplementations or make similar substitutions on the basis of the described specific embodiments. The amendments, supplementations and substitutions should fall within the principle or the protective scope claimed by the claims of the present disclosure.

The invention claimed is:

1. A projection lamp with a rolling lamp effect, comprising:

an outer housing, which is an inner hollow structure with an opening;

a lampshade, which is a light transmitting structure, covering the opening of the outer housing and fixedly connected to the outer housing;

a light emitting module, fixed in the outer housing through a fixed shaft, wherein the light projecting direction of the light emitting module points at the lampshade;

a light condensing ball lens, disposed in the outer housing, wherein a shaft sleeve is disposed at the outer surface of the light condensing ball lens in a protruding way, the light emitting module is positioned in the light condensing ball lens and the fixed shaft is positioned in the shaft sleeve; and a motor, which is fixedly disposed in the outer housing and is in a transmission connection with the shaft sleeve, wherein the motor is capable of driving the light condensing ball lens to rotate around the axis of the shaft sleeve in the outer housing.

2. The projection lamp with a rolling lamp effect according to claim 1, wherein the shaft sleeve is externally sleeved with a transmission sleeve which is in a fixed connection with the shaft sleeve; the transmission sleeve is in a transmission connection with the motor through a gear, and the shaft sleeve is capable of synchronously rotating along with the transmission sleeve.

3. The projection lamp with a rolling lamp effect according to claim 2, wherein the transmission sleeve has one end which is fixedly connected with a gear ring; the gear ring is internally provided with a positioning bearing; the positioning bearing is pressed against the transmission sleeve and respectively fits tightly with the gear ring and the fixed shaft; an output shaft of the motor is provided with a gear, and the gear is in an engaged connection with the gear ring.

4. The projection lamp with a rolling lamp effect according to claim 3, wherein the inner diameter of the gear ring is greater than the inner diameter of the transmission sleeve; a platform is formed between the transmission sleeve and the gear ring; and the positioning bearing is pressed against the platform.

5. The projection lamp with a rolling lamp effect according to claim 2, wherein the transmission sleeve is sleeved with a positioning ring; the positioning ring is positioned between the motor and the lampshade and remains fixed relative to the motor and the lampshade; and the transmission sleeve is capable of rotating in the positioning ring.

6. The projection lamp with a rolling lamp effect according to claim 5, wherein a support board is disposed between the motor and the positioning ring; the support board has one end pressed against the motor and the other end provided with an arc-shaped groove; and the positioning ring is positioned in the arc-shaped groove and is tightly pressed against the support board.

7. The projection lamp with a rolling lamp effect according to claim 6, wherein a baffle, which is fixedly connected with the support board and tightly presses the positioning ring against the transmission sleeve, is disposed on one side of the arc-shaped groove.

8. The projection lamp with a rolling lamp effect according to claim 6, wherein an arc-shaped positioning sleeve is disposed at one end of the support board; the two ends of the arc-shaped positioning sleeve respectively extend out of a mounting portion; a mounting seat is disposed on the inner surface of the outer housing; the motor is disposed in the mounting seat; the motor is positioned in the arc-shaped sleeve, and the mounting portion is fixedly connected with the mounting seat.

9. The projection lamp with a rolling lamp effect according to claim 8, wherein a stopper is disposed on one side of the limiting seat, and the positioning ring is pressed against the stopper.

10. The projection lamp with a rolling lamp effect according to claim 5, wherein a main cover plate is fixedly disposed in the outer housing; a limiting seat is fixedly disposed on the inner surface of the main cover plate; the limiting seat is formed with a limiting groove; and the positioning ring is positioned in the limiting groove and pressed against the limiting seat.

11. The projection lamp with a rolling lamp effect according to claim 1, wherein an auxiliary cover plate is fixedly disposed in the outer housing; a limiting plate is fixedly disposed on the inner surface of the auxiliary cover plate; the limiting plate is formed with a limiting hole; a limiting shaft which is coaxial with the shaft sleeve is disposed on the outer surface of the light condensing ball lens in a protruding way; and the limiting shaft extends into the limiting hole and is spaced from the limiting hole.

12. The projection lamp with a rolling lamp effect according to claim 11, wherein the light condensing ball lens is enclosed by two left and right hollow semi-spheres; a plurality of convex lenses which are connected in turn are uniformly disposed on the inner surface of each one of the left and right two semi-spheres; each one of the shaft sleeve and the limiting shaft is enclosed by parts which are respectively positioned on the left and right two semi-spheres; and the light emitting module is positioned in the two semi-spheres.

13. The projection lamp with a rolling lamp effect according to claim 12, wherein the limiting shaft is sleeved with a shaft cover, and the shaft cover is in a plugged connection with the limiting shaft.

14. The projection lamp with a rolling lamp effect according to claim 1, wherein the outer housing is internally provided with a fixed seat which is in a fixed connection with the outer housing; the fixed seat is provided with a fixed sleeve; and the fixed shaft is fixedly connected with the fixed sleeve in a plugged way.

15. The projection lamp with a rolling lamp effect according to claim 14, wherein a plug board which is in a plugged connection with the inner surface of the outer housing is disposed on the lower surface of the fixed seat in a protruding way.

16. The projection lamp with a rolling lamp effect according to claim 1, wherein the light emitting module comprises:

a lamp base having two adjacent mounting grooves which are disposed in an inclined way;

two lamp panels respectively embedded in two mounting grooves, wherein each one of the lamp panels is provided with a light emitting element; and a connecting board fixedly connected to one side of the lamp base, wherein a connecting sleeve is fixedly disposed on the surface of the connecting board, and the fixed shaft is fixedly connected with the connecting sleeve in a plugged way.

17. The projection lamp with a rolling lamp effect according to claim 1, wherein the outer housing is internally equipped with a circuit board; the circuit board is electrically connected with the light emitting module and the motor, respectively; and the circuit board is provided with a power switch and a wiring plug that penetrate through the outer housing and are fixedly connected with the outer housing.

* * * * *